US008327769B2

(12) United States Patent
Kim

(10) Patent No.: US 8,327,769 B2
(45) Date of Patent: Dec. 11, 2012

(54) LARGE RIDEABLE BIPEDAL WALKING ROBOT FOR USE AS AN AMUSEMENT PARK RIDE AND AMUSEMENT PARK SYSTEM USING THE SAME

(76) Inventor: In-Sang Kim, Whasung-Si (KR)

( * ) Notice: Subject to any disclaimer, the term of this patent is extended or adjusted under 35 U.S.C. 154(b) by 0 days.

(21) Appl. No.: 13/032,773

(22) Filed: Feb. 23, 2011

(65) Prior Publication Data

US 2011/0139030 A1 Jun. 16, 2011

(30) Foreign Application Priority Data

Aug. 23, 2008 (KR) ..... 10-2008-0082618
Aug. 24, 2009 (WO) ..... PCT/KR2009/004706

(51) Int. Cl.
*A63G 1/00* (2006.01)

(52) U.S. Cl. ..... 104/53; 472/27

(58) Field of Classification Search ..... 104/53; 180/8.1, 7.1, 187, 203; 472/1–47
See application file for complete search history.

(56) References Cited

U.S. PATENT DOCUMENTS 3,085,516 A * 4/1963 Cirami ..... 104/247
3,093,372 A * 6/1963 Cirami ..... 472/27
3,120,197 A * 2/1964 Cirami ..... 104/245
3,137,501 A * 6/1964 Cirami ..... 472/137
3,507,222 A * 4/1970 Cirami ..... 104/53
3,680,487 A * 8/1972 Cirami ..... 104/53
6,311,625 B1 * 11/2001 Ostrobrod ..... 104/91
6,341,564 B1 * 1/2002 Ochi ..... 104/53
6,507,163 B1 * 1/2003 Allen ..... 318/560
7,802,522 B2 * 9/2010 Gordon ..... 104/53
2007/0089632 A1 * 4/2007 Gordon ..... 104/53
2010/0062868 A1 * 3/2010 Mordelt ..... 472/131
2011/0139030 A1 * 6/2011 Kim ..... 104/53

* cited by examiner

*Primary Examiner* — Jason C Smith
(74) *Attorney, Agent, or Firm* — NSIP Law

(57) ABSTRACT

A large bipedal walking robot that a human can directly board and ride and that may be used as an amusement park ride, and to an amusement park system using the same includes a large bipedal walking robot capable of being boarded and ridden, a boarding vehicle to be coupled to the head or body of the robot, a safety cable and a safety rail that prevent the robot from falling, a safety vehicle that prevents the robot, but not the safety cable, from falling and makes the robot's bipedal walking steadier, connection means enabling the robot to be connected to a roller coaster (tram railway) in order to provide the effect of a flying robot, and a tunnel in which various villain robots are installed to provide an experience of the robot engaging in combat, and safety rails installed and connected in all areas where the robot moves.

16 Claims, 19 Drawing Sheets

LARGE RIDEABLE BIPEDAL WALKING ROBOT FOR USE AS AN AMUSEMENT PARK RIDE AND AMUSEMENT PARK SYSTEM USING THE SAME

CROSS-REFERENCE TO RELATED APPLICATIONS

This application is a continuation application of International Patent Application No. PCT/KR2009/004706, filed on Aug. 24, 2009, which claims the benefit of Korean Patent Application No. 10-2008-0082618, filed on Aug. 23, 2008, in the Korean Intellectual Property Office, the entire disclosure of each of which is incorporated herein by reference for all purposes.

BACKGROUND

1. Field

The following description relates to a large rideable bipedal walking robot that a human can directly board and ride and that can be utilized as an amusement park ride like a roller coaster, and an amusement park system using the large rideable bipedal walking robot.

2. Description of Related Art

With the rapid advancement of computers, artificial intelligence technologies and control engineering have been developed to allow bipedal walking robots to gently walk and move. Especially, a humanoid robot like "Asimo" made by Honda in Japan can run, and a robot like "Hubo" made by Kaist in Korea can walk and move naturally.

As the robot technologies are generalized, further, robot kits with which bipedal walking robots are easily assembled and made like Lego blocks are supplied to general people and students. Also, various bipedal walking robot battle contests have been opened popularily.

Actually, however, the bipedal walking robots have been developed just as helpers that provide the conveniences in everyday life, that is, clean the house or carry coffee, so that the heights of the robots are less than 1M like a robot vacuum cleaner and the heights of the humanoid robots like "Asimo" and "Hubo" are less than 1.5 m to 2 m. Accordingly, the bipedal walking robots cannot be ridden and moved directly by the manipulation of the human like automobiles, trucks, fork cranes and so on.

In the meantime, large-sized humanoid bipedal walking robots like "Robot Taekwon V" and "Mazinger Z" appearing in SF movies or comic books have been not studied and developed at all up to now. The large bipedal walking robots have relatively low efficiencies in their movement and power when compared with four legs walking robots or large robots with wheels like a tank, providing a low degree of practicability. As a result, many studies on the large bipedal walking robots have been not proposed.

However, such four legs walking robots or large robots with wheels look less friendly to humans when compared with the humanoid robots appearing in movies.

SUMMARY

Other features and aspects may be apparent from the following detailed description, the drawings, and the claims.

Figure 1:
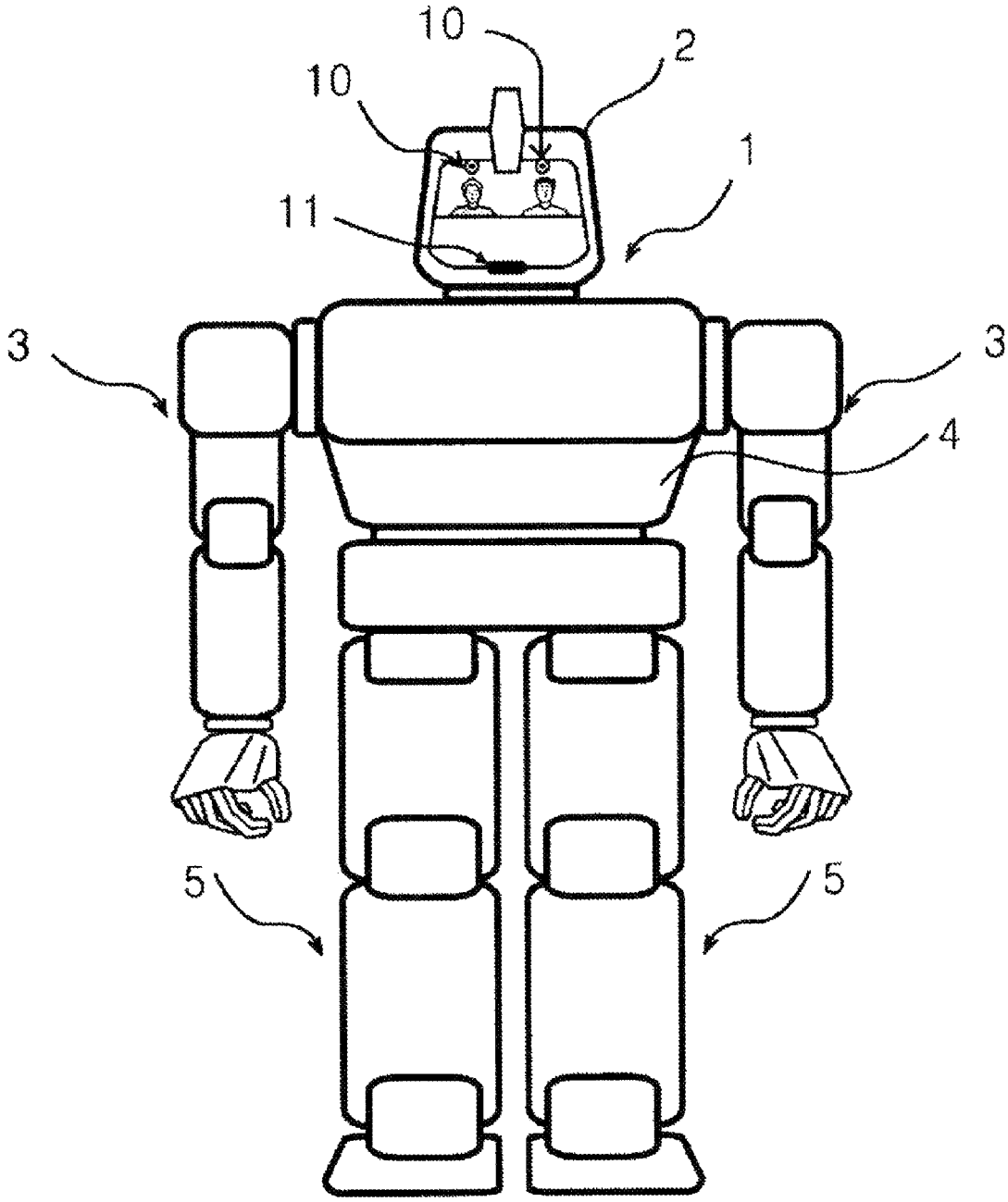
FIG. 1 is a front view showing a bipedal walking robot according to an embodiment.

Throughout the drawings and the detailed description, unless otherwise described, the same drawing reference numerals should be understood to refer to the same elements, features, and structures. The relative size and depiction of these elements may be exaggerated for clarity, illustration, and convenience.

DETAILED DESCRIPTION

The following detailed description is provided to assist the reader in gaining a comprehensive understanding of the methods, apparatuses, and/or systems described herein. Accordingly, various changes, modifications, and equivalents of the systems, apparatuses and/or methods described herein will be suggested to those of ordinary skill in the art. The progression of processing steps and/or operations described is an example; however, the sequence of steps and/or operations is not limited to that set forth herein and may be changed as is known in the art, with the exception of steps and/or operations necessarily occurring in a certain order. Also, descriptions of well-known functions and constructions may be omitted for increased clarity and conciseness.

Hereinafter, an explanation on a large rideable bipedal walking robot according to an embodiment of the present invention will be in detail given with reference to the attached drawings.

Figure 2:
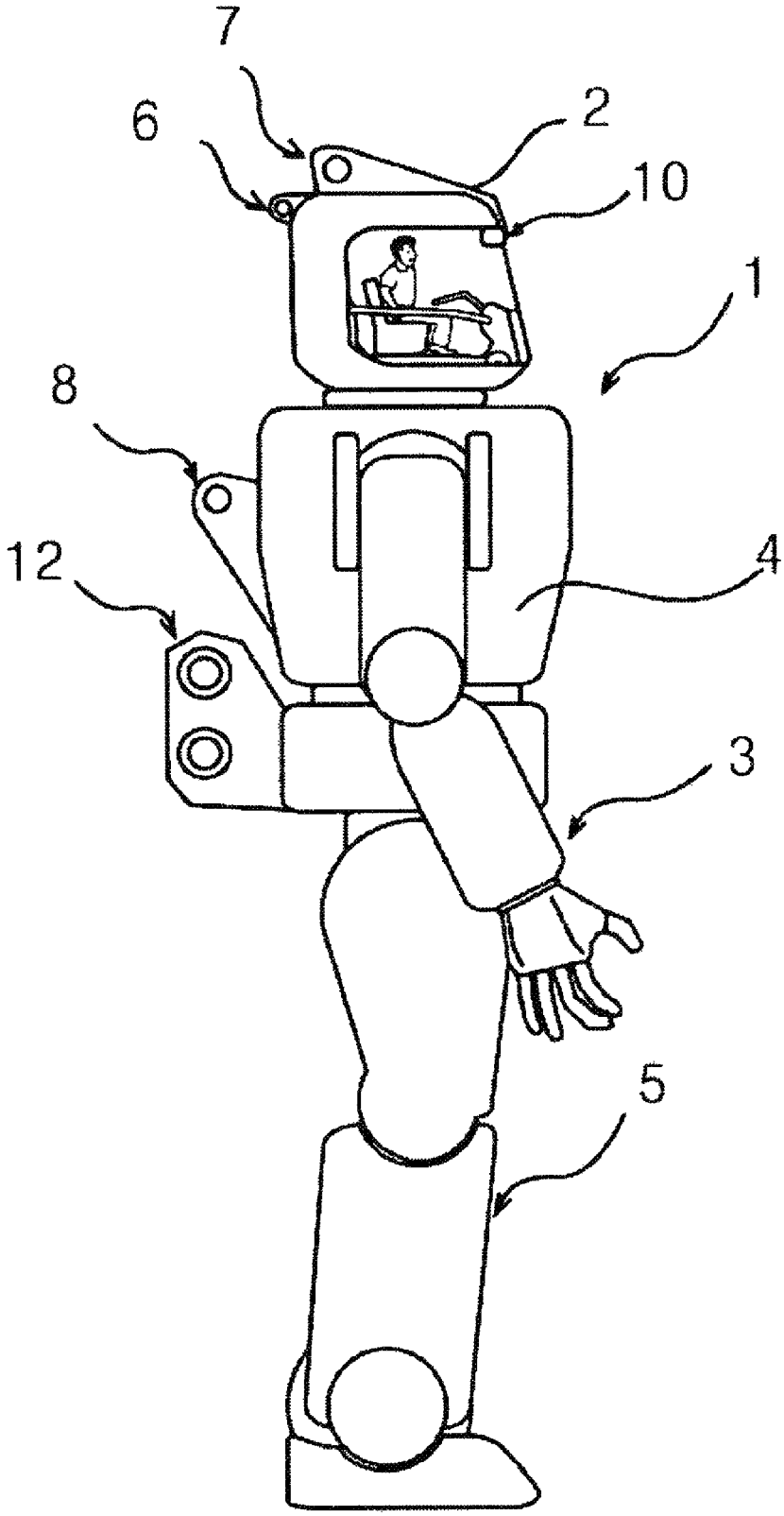
FIG. 2 is a side view showing the bipedal walking robot of FIG. 1.
Figure 3:
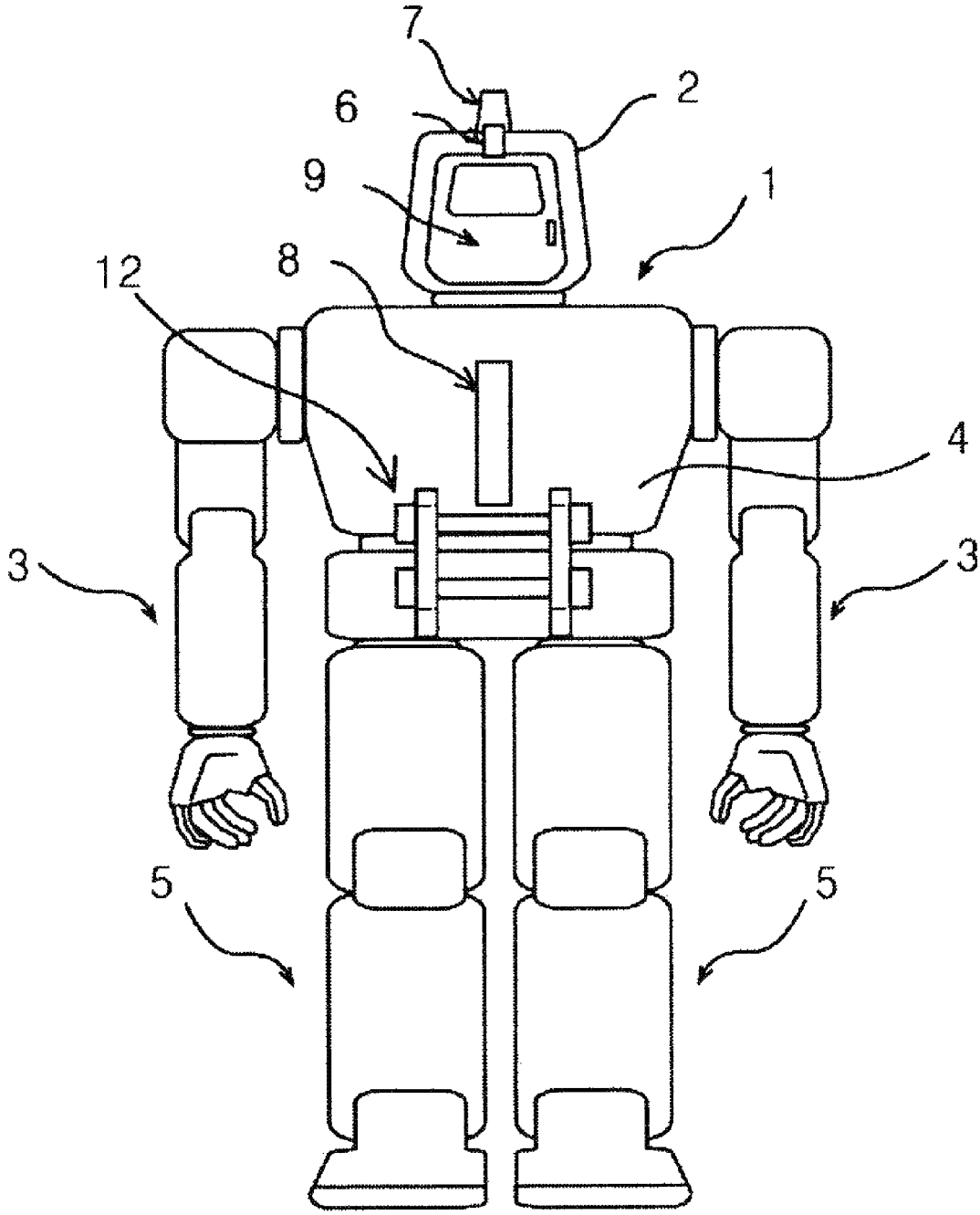
FIG. 3 is a rear view showing the bipedal walking robot of FIG. 1.
Figure 4:
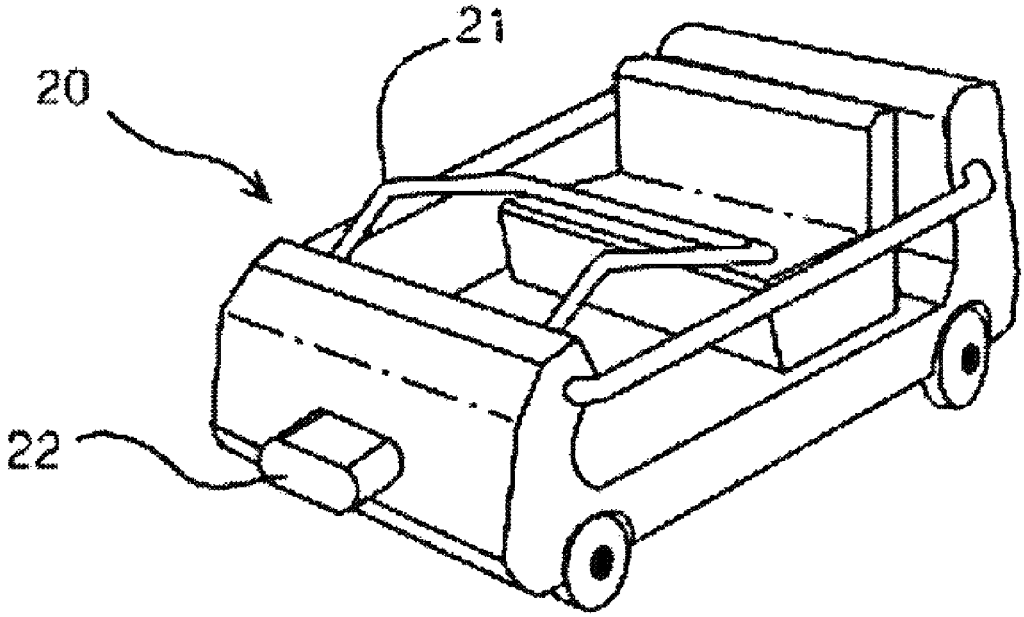
FIG. 4 is a perspective view showing a boarding vehicle coupled to a body of the bipedal walking robot of FIG. 1.
Figure 5:
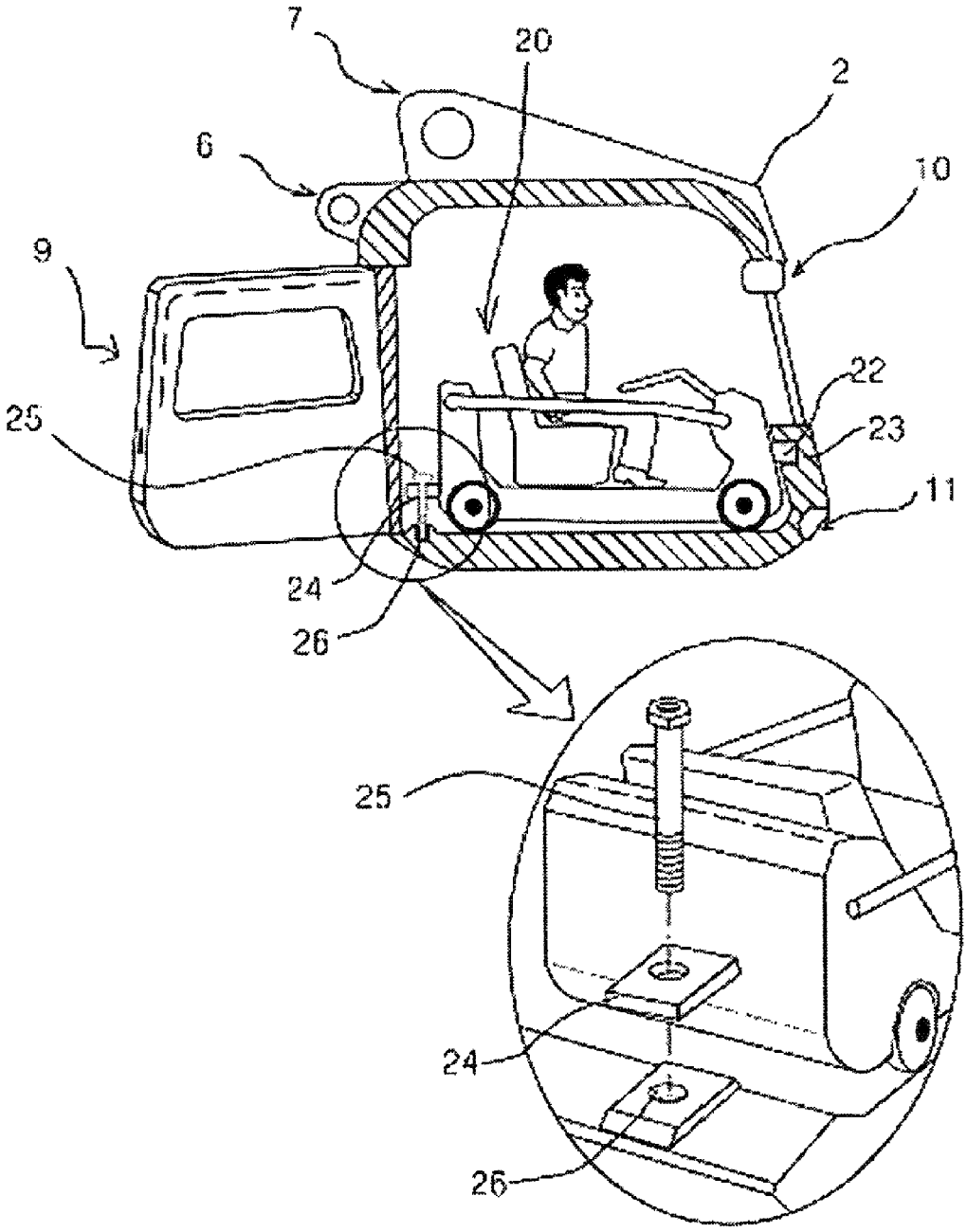
FIG. 5 is a side view showing the coupling of the boarding vehicle of FIG. 4 to the bipedal walking robot of FIG. 1.
Figure 6:
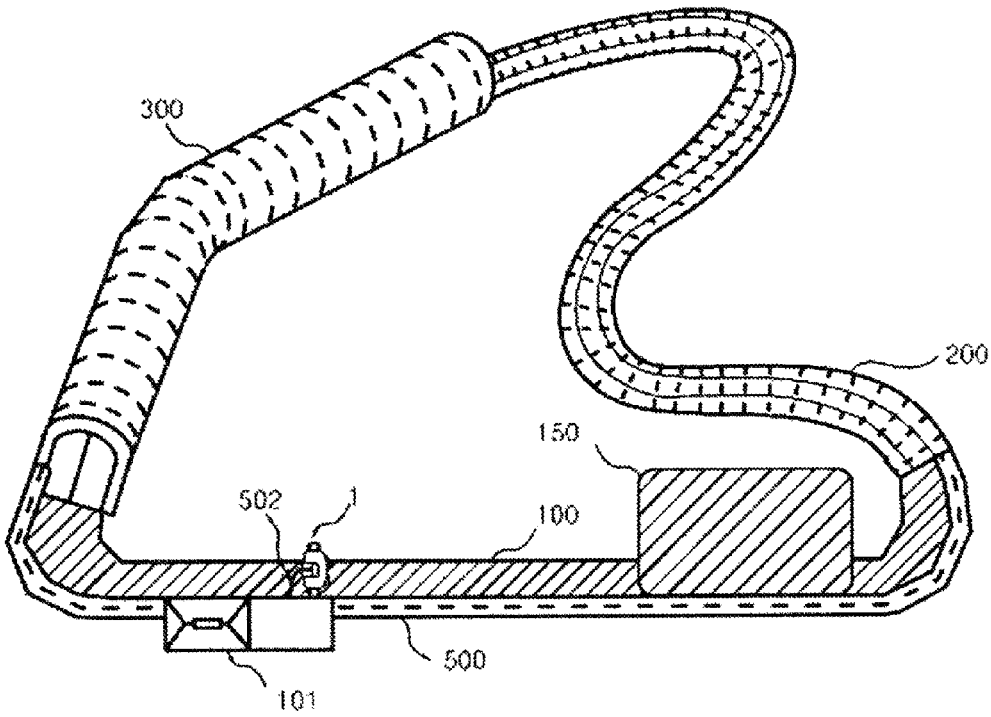
FIG. 6 is an example view showing a theme park composed of a walking road, a free riding road, a ride and/or a roller coaster, and a tunnel, along which the bipedal walking robot of FIG. 1. is moved.
Figure 7:
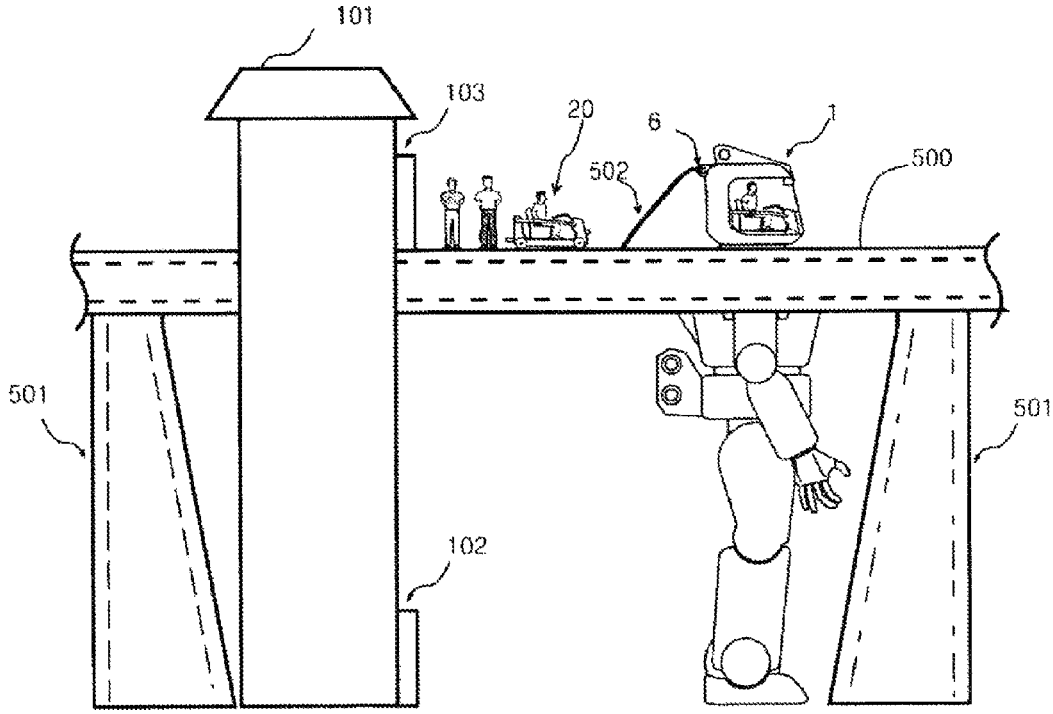
FIG. 7 is an example view showing a boarding area where a pilot and riders board the bipedal walking robot of FIG. 1.
Figure 8:
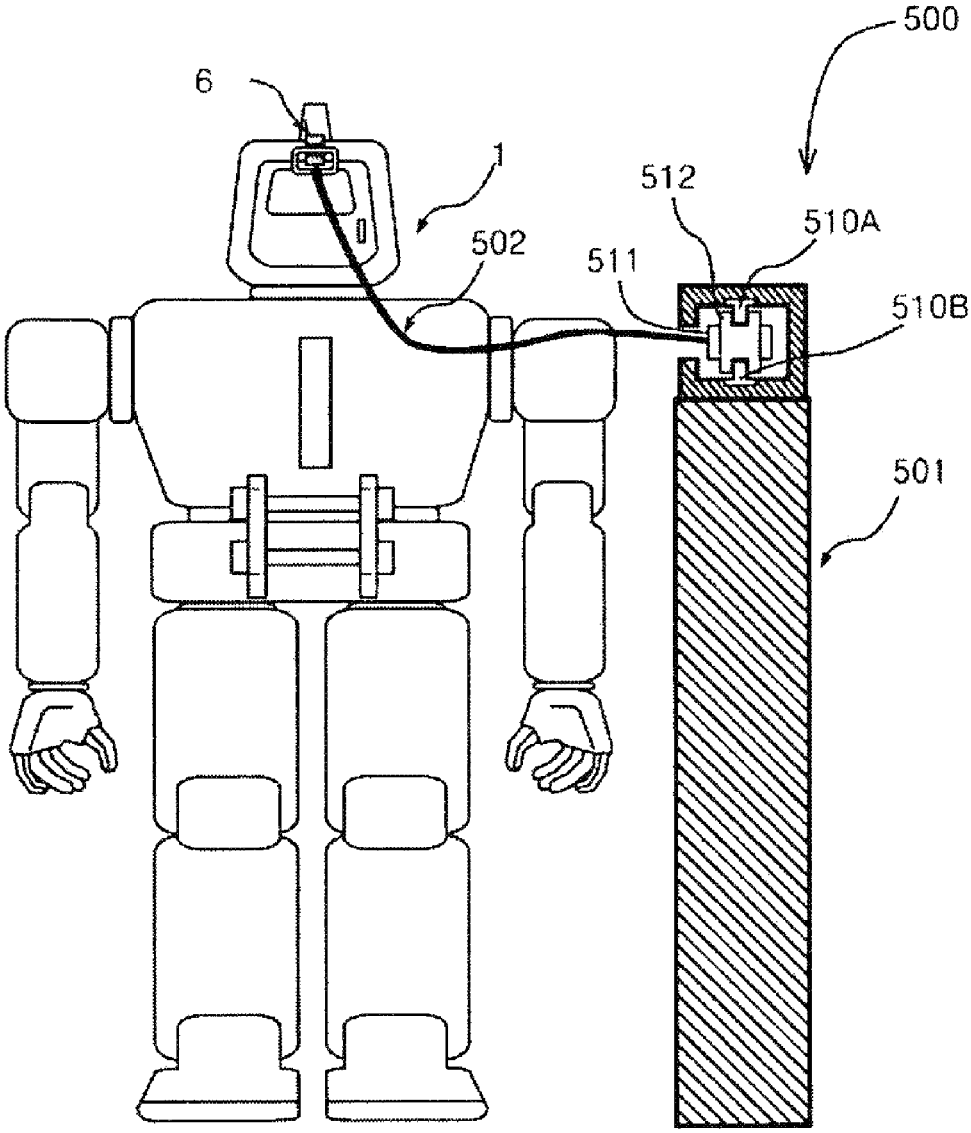
FIG. 8 is a rear view showing a state where a safety rail part is connected by means of a safety cable to the bipedal walking robot of FIG. 1.
Figure 9:
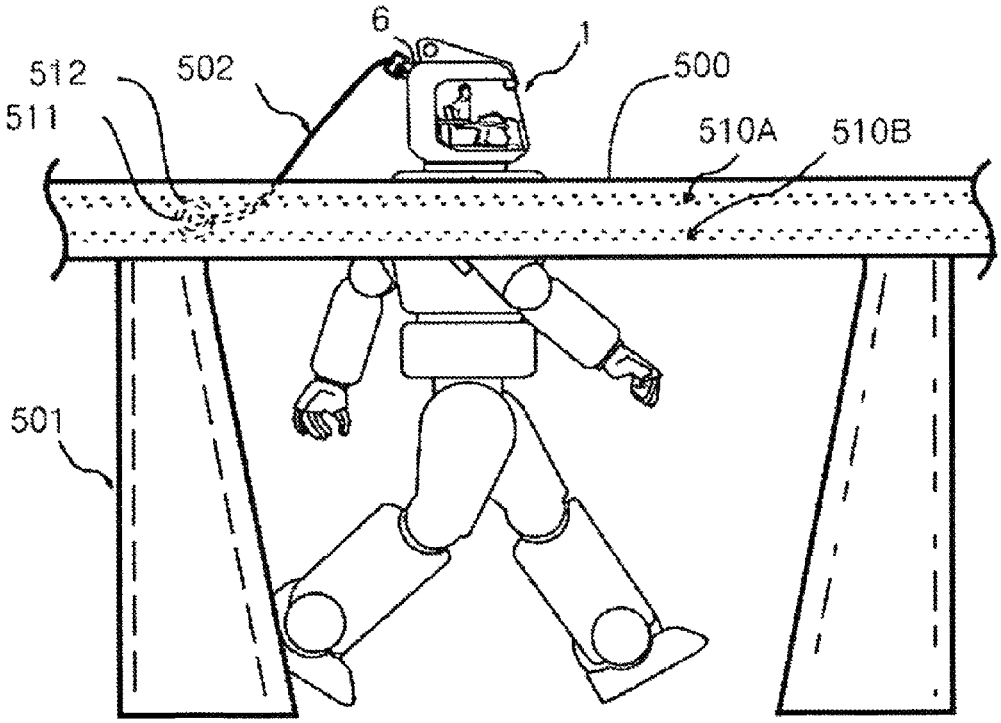
FIG. 9 is a side view showing a state where the bipedal walking robot of FIG. 1. walks along the safety rails of the safety rail part.
Figure 10:
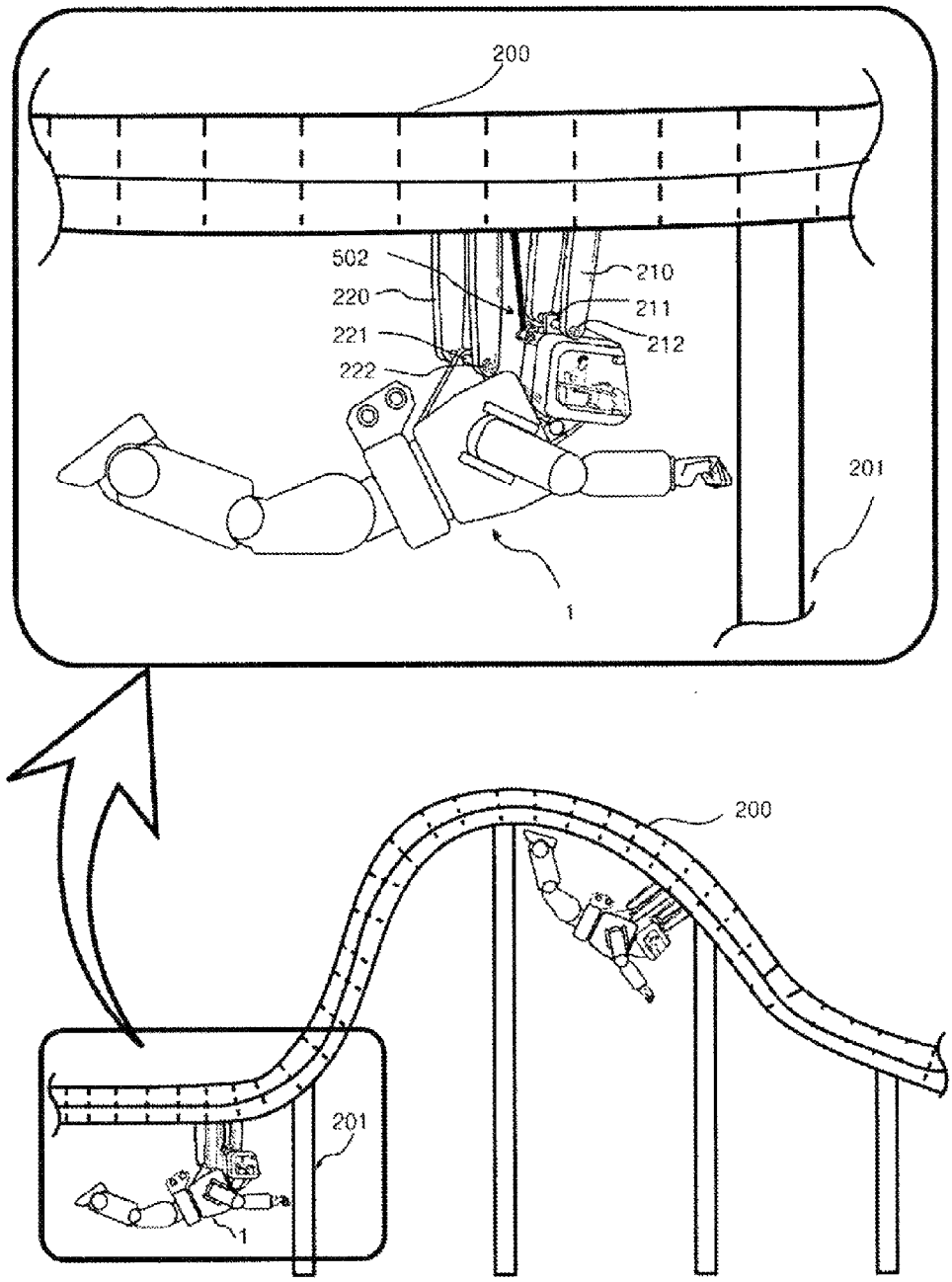
FIG. 10 is an example view showing a state where a roller coaster is coupled to the bipedal walking robot of FIG. 1.
Figure 11:
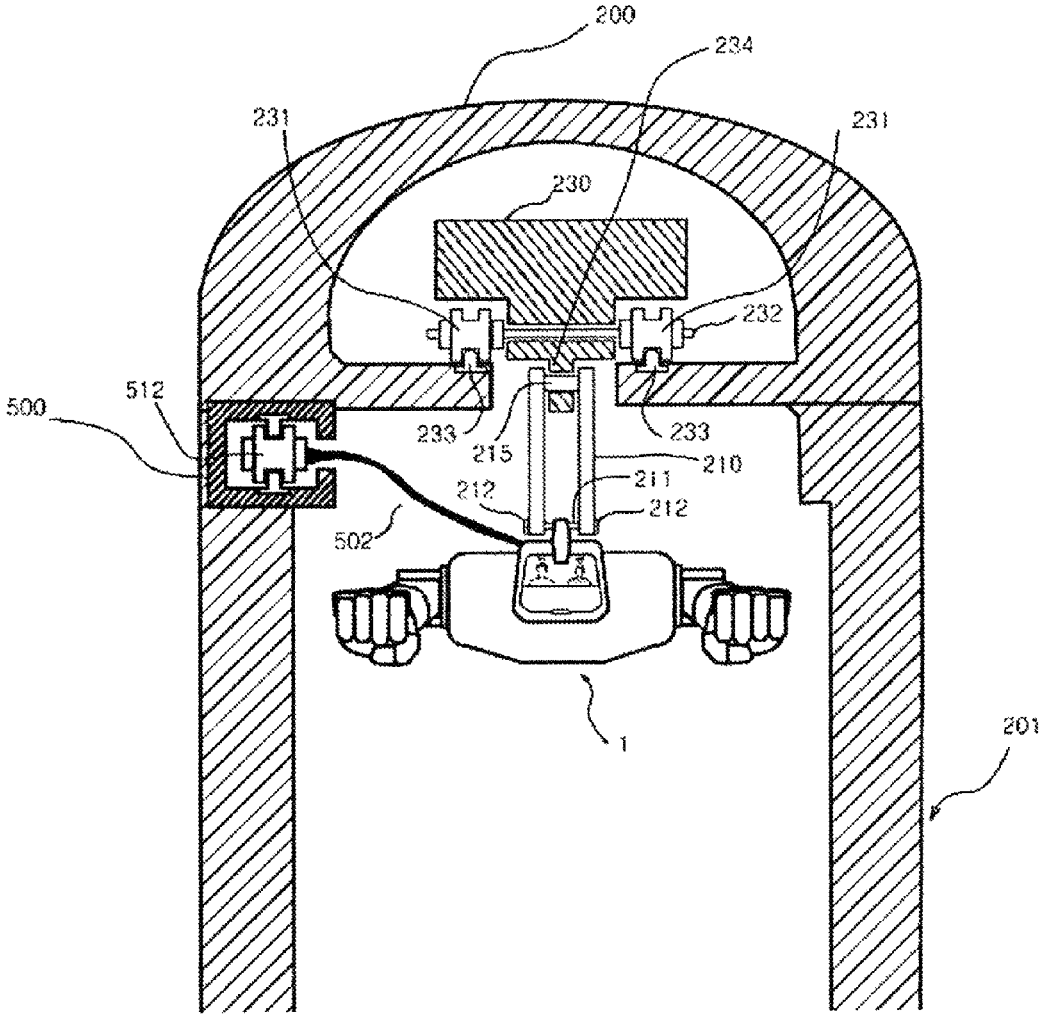
FIG. 11 is a front sectional view showing the coupled state of FIG. 10.
Figure 12:
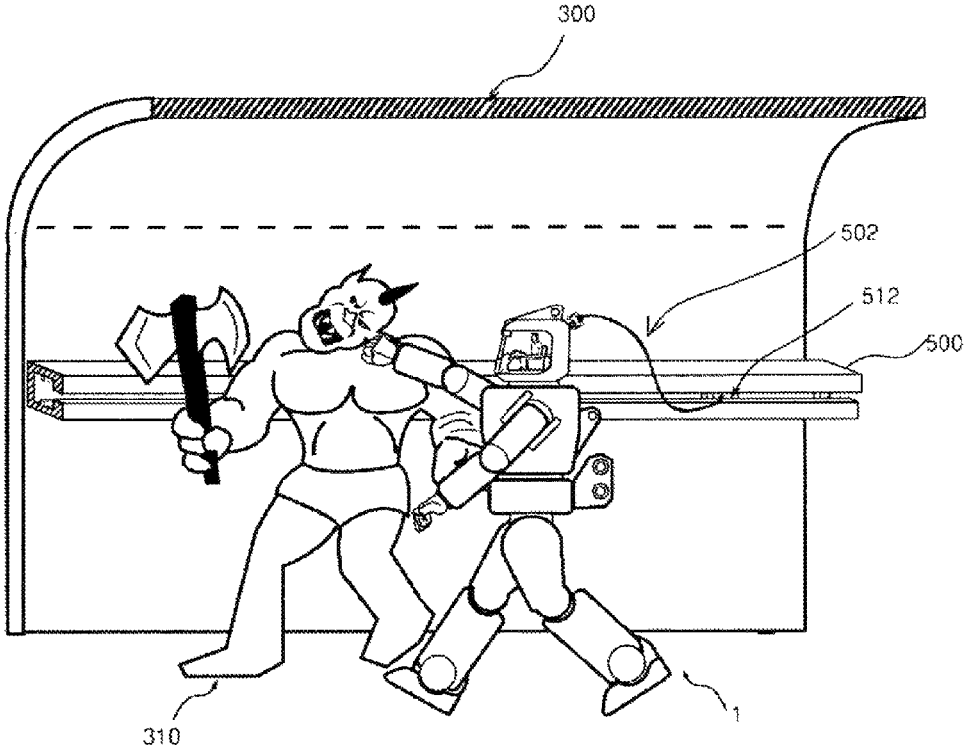
FIG. 12 is an example view showing a state where the bipedal walking robot of FIG. 1. hits a villain robot in the tunnel.
Figure 13:
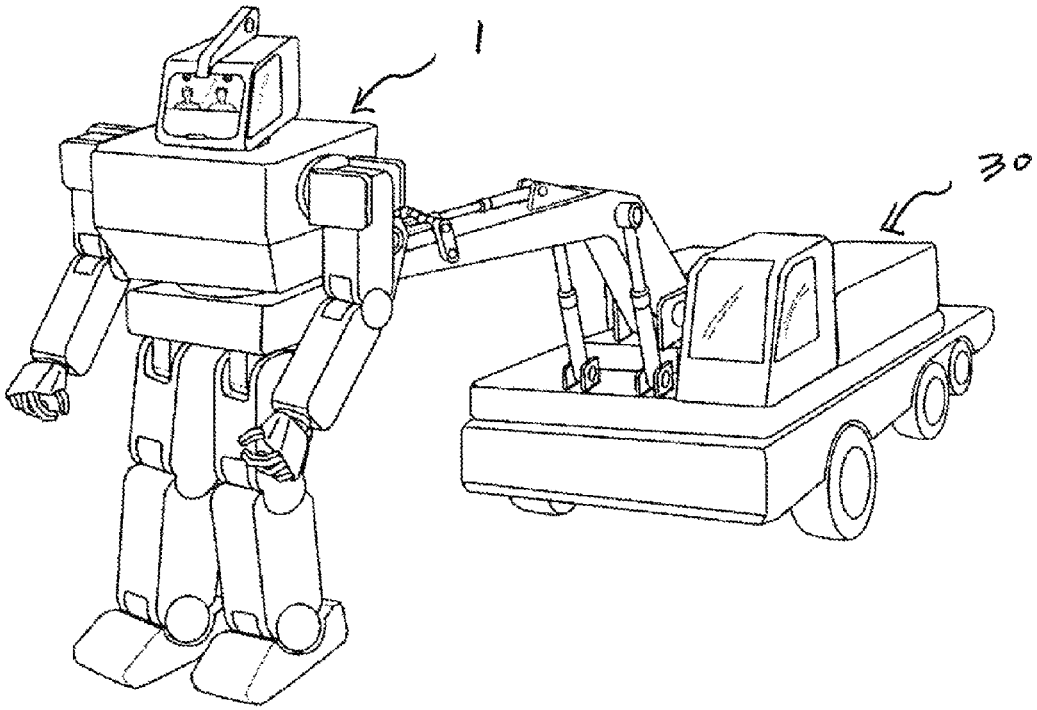
FIG. 13 is a perspective view showing a large rideable bipedal walking robot coupled to a safety vehicle according to another embodiment.
Figure 14:
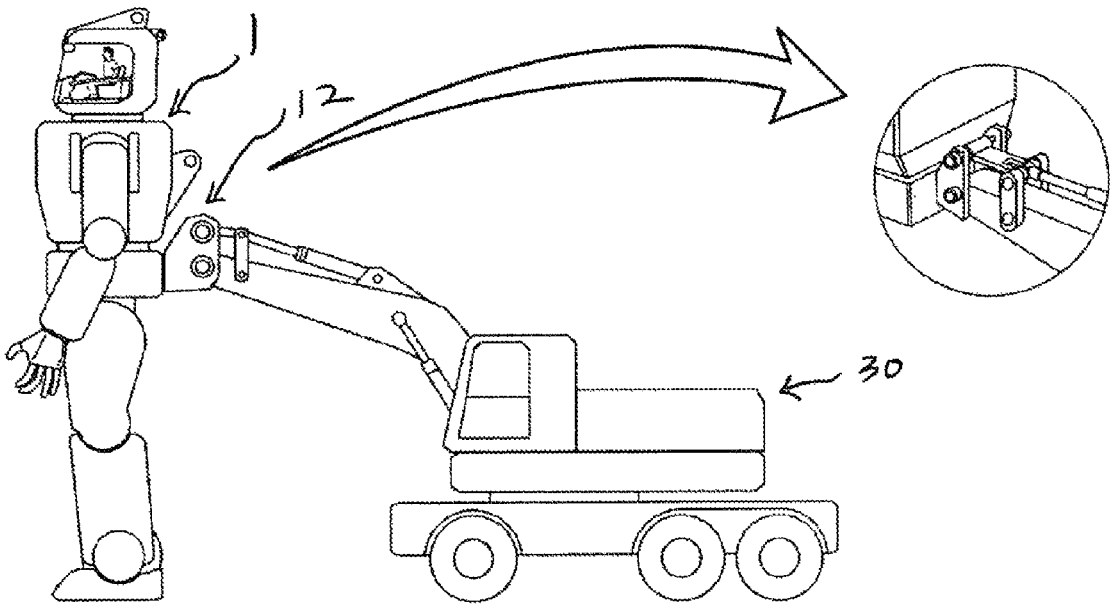
FIG. 14 is a right side view showing the bipedal walking robot of FIG. 13 and the safety vehicle.
Figure 15:
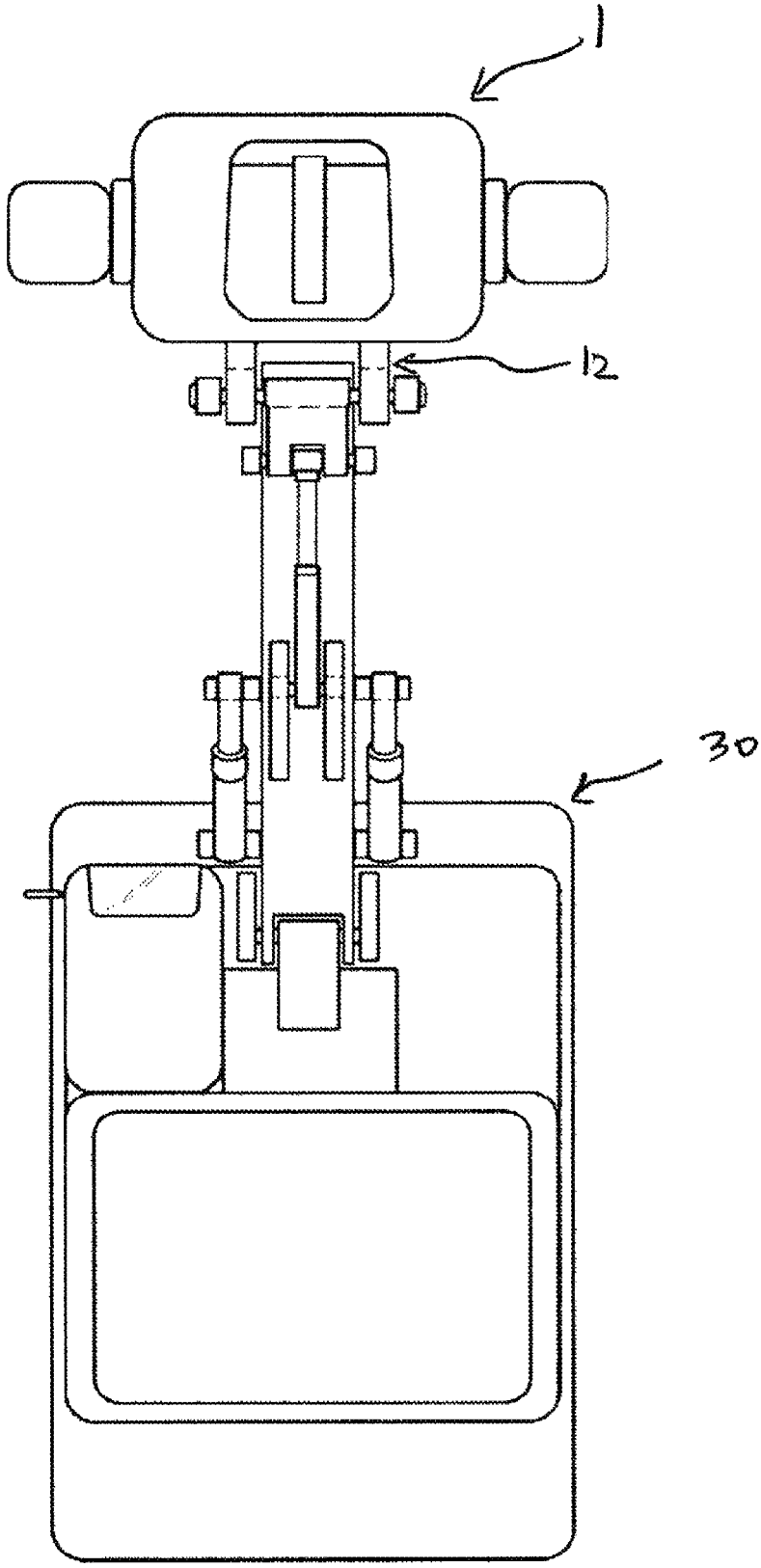
FIG. 15 is a plan view showing the bipedal walking robot of FIG. 13.
Figure 16:
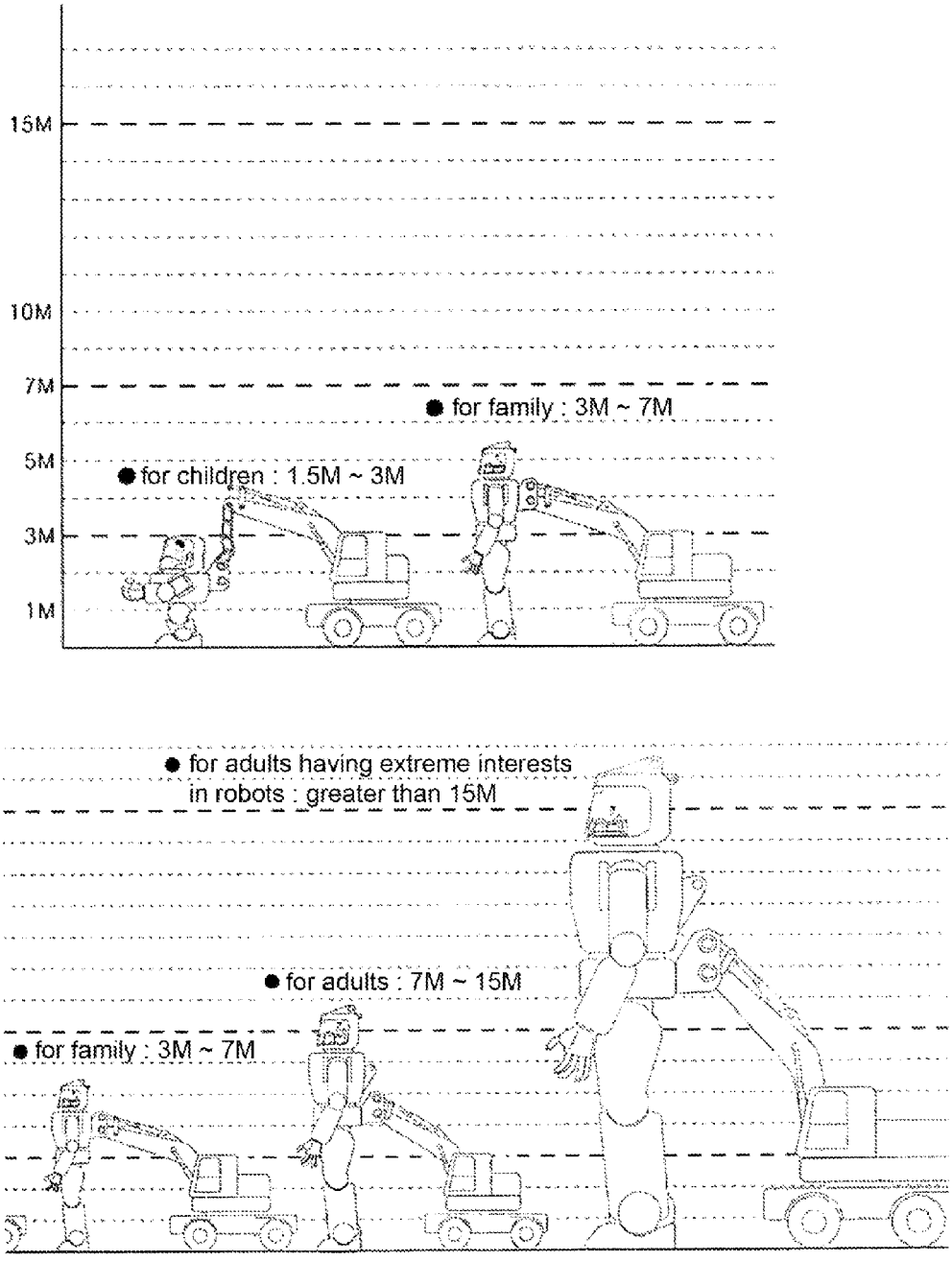
FIG. 16 is an example view showing the variations of the height of the bipedal walking robot of FIG. 13 and the safety vehicle in accordance with the ages and tendency of the riders.
Figure 17:
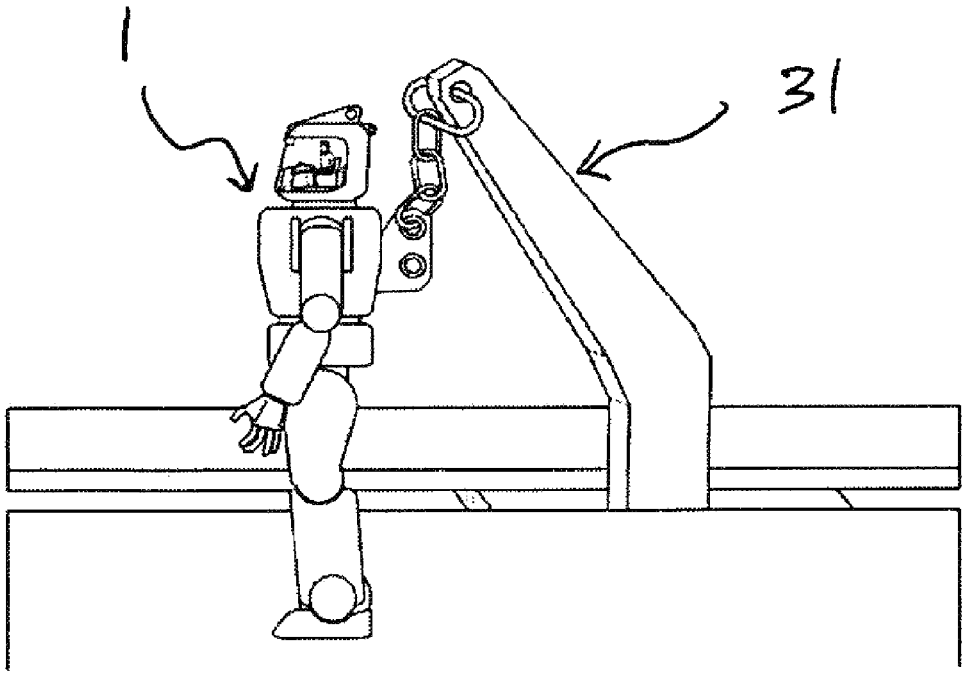
FIG. 17 is an example view showing a state where the safety vehicle of FIG. 13 is positioned on underground rails.
Figure 18:
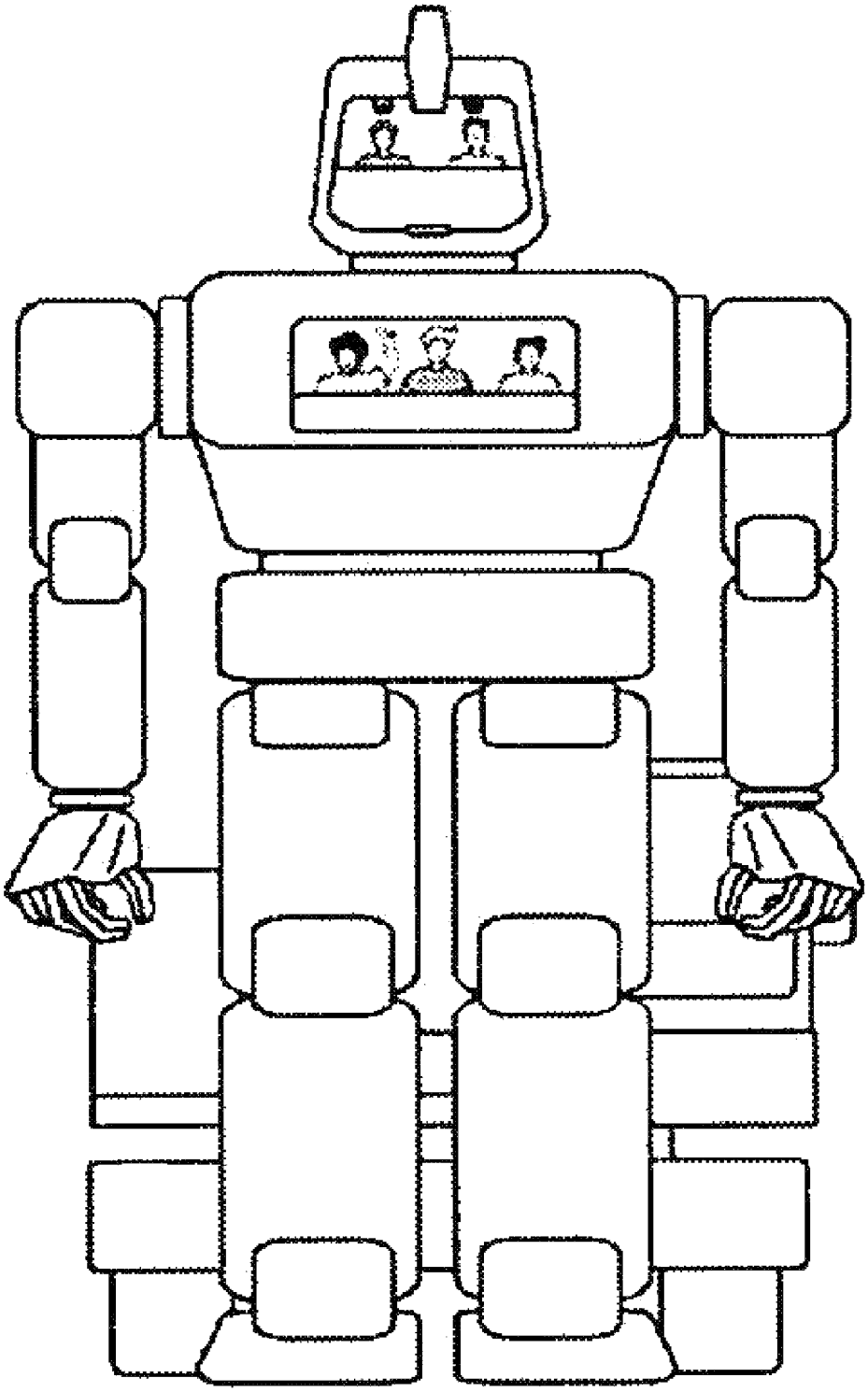
FIG. 18 is an example view showing a state where the boarding space of the bipedal walking robot of FIG. 1 is also formed in the robot body.
Figure 19:
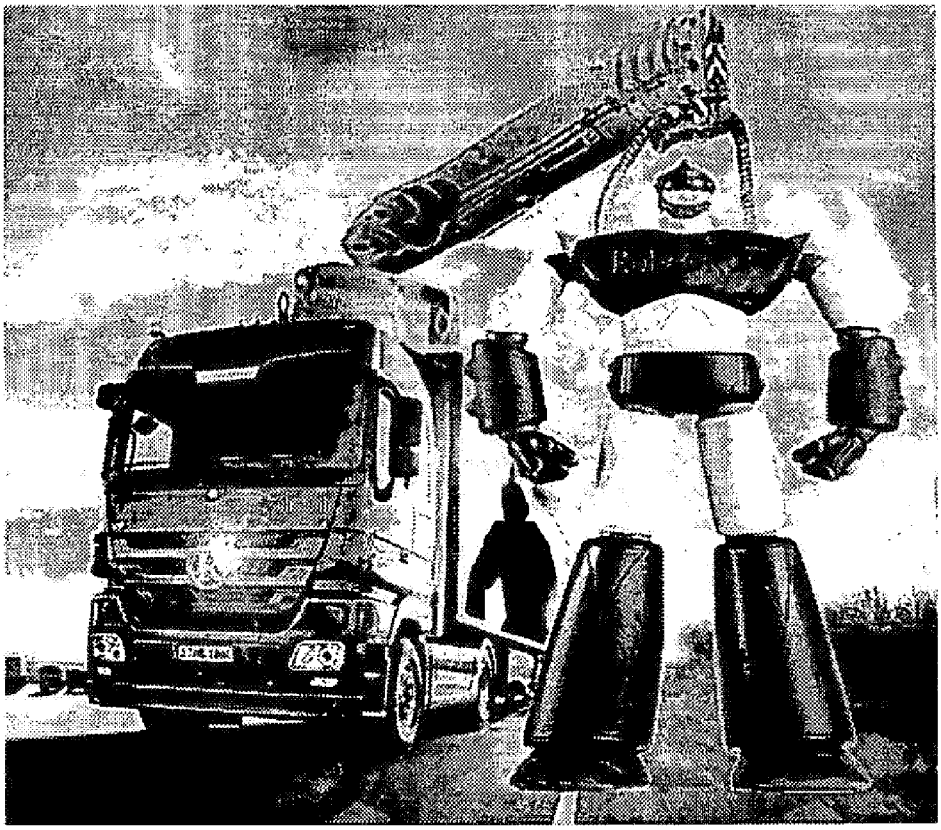
FIG. 19 is an example view showing an example where the bipedal walking robot of FIG. 13 is coupled to the safety vehicle.

FIG. 1 is a front view showing a large rideable bipedal walking robot for an amusement park ride according to an embodiment of the present invention, FIG. 2 is a side view of the bipedal walking robot, FIG. 3 is a rear view of the bipedal walking robot, FIG. 4 is a perspective view showing a boarding vehicle coupled to a body of the bipedal walking robot, FIG. 5 is a side view showing the coupling of the boarding vehicle of FIG. 4 to the bipedal walking robot, FIG. 6 is an example view showing a theme park composed of a walking road, a free riding road, a ride and/or a roller coaster, and a tunnel, along which the bipedal walking robot is moved, FIG. 7 is an example view showing a boarding area where a pilot and riders board the bipedal walking robot, FIG. 8 is a rear view showing a state where a safety rail part is connected by means of a safety cable to the bipedal walking robot, FIG. 9 is a side view showing a state where the robot walks along the safety rails of the safety rail part, FIG. 10 is an example view showing a state where a roller coaster is coupled to the bipedal walking robot, FIG. 11 is a front sectional view of FIG. 10, FIG. 12 is an example view showing a state where the bipedal walking robot hits a villain robot in the tunnel, FIG. 13 is a perspective view showing a large rideable bipedal walking robot coupled to a safety vehicle according to another embodiment of the present invention, FIG. 14 is a right side view showing the bipedal walking robot of FIG. 13 and the safety vehicle, FIG. 15 is a plan view showing the bipedal walking robot of FIG. 13, FIG. 16 is an example view showing the variations of the height of the bipedal walking robot of FIG. 13 and the safety vehicle in accordance with the ages and tendency of the riders, FIG. 17 is an example view showing a state where the safety vehicle of FIG. 13 is positioned on underground rails, FIG. 18 is an example view showing a state where the boarding space of the bipedal walking robot of FIG. 1 is also formed in the robot body, and FIG. 19 is an example view showing an example where the bipedal walking robot of FIG. 13 is coupled to the safety vehicle.

As shown in FIG. 1, a large rideable bipedal walking robot 1 of the invention includes two leg links 5, an upper body 4 disposed on the top sides of the two leg links 5, a head 2 disposed on the top side of the upper body 4, and two arm links 3 connected to both sides of the upper body 4. The head 2 has two headlights 10 and a speaker 11 mounted thereon. In the interior of the upper body 4 are provided a control unit like a computer, a motor (driving source) activating the links 3 and 5 of the robot 1, and an engine source (such as an engine, batteries, power supply equipment and so on), which are not shown in the drawings. Also, the robot 1 as shown in FIGS. 1 to 3 has a cover mounted thereon so as to protect the internal structure thereof.

As shown in FIGS. 2 and 3, the head 2 has a safety cable connector 6 adapted to connect a safety cable thereto and a head connector 7 adapted to connect a roller coaster thereto, and the upper body 4 has an upper body connector 8 adapted to connect the roller coaster thereto.

The walking technology of the robot 1 as shown in FIGS. 1 to 3 is adopted from that of the humanoid robots conventionally known. For example, it can be adopted freely from the walking technologies of the Honda robot "Asimo", Kaist robot "Hubo", and various humanoid robots appearing in robot game contests.

Further, an explanation on the energy source and power housed in the upper body 4 of the robot 1 will be given.

The power of the large bipedal walking robot includes the energy sources used for existing large fork cranes, cranes and industrial robots. For instance, the power is utilized with oil energy like gas and diesel, fuel cells, electricity and so on, and further, it is utilized with hybrid energy. In the meantime, so as to convert the energy of the robot 1 into energy to move the arms, legs, head, and upper body, an electric motor, a hydraulic pump, a hydraulic motor, an actuator, and a hydraulic cylinder are utilized.

Referring to FIGS. 4 and 5, an explanation on the coupling structure between the robot 1 and the boarding vehicle 20 will be given.

As shown, the boarding vehicle 20 has a front insertion protrusion 22 formed at the front surface thereof in such a manner as to be inserted into a front insertion groove 23 formed on the head 2 of the robot 1.

Also, the boarding vehicle 20 has a back insertion groove connector 24 mounted at the back surface thereof, and the head 2 of the robot 1 has a back insertion groove 26 formed thereon, such that the back insertion groove connector 24 and the back insertion groove 26 are fixed to each other by means of a back insertion screw 25, allowing the boarding vehicle 20 to be rigidly fixed to the head 2 of the robot 1.

Additionally, the boarding vehicle 20 is provided with a rotatable safety leg bar 21 so as to allow the riders to board the boarding vehicle safely.

Further, as shown in FIG. 5, the head 2 of the robot 1 has an entrance door 9 formed to be opened and closed at the back surface thereof, through which the boarding vehicle 20 goes and comes.

Of course, if the inside (of the head 2) of the robot 1 has a boarding space, seats and safety belts formed therein under the circumstances, it is possible to allow riders to directly board the boarding space of the robot 1, without using the boarding vehicle 20.

If the boarding vehicle 20 is coupled to the head 2 of the robot 1 or if the riders directly board the robot 1, the robot 1 is moved under the manipulation of a pilot of the robot 1. Of course, the robot 1 walks and moves by himself by utilizing his artificial intelligence or is controlled remotely in his movement. As the robot 1 walks, the riders can obtain new experiences, while seeing surrounding views, and when the robot 1 takes dynamic action of running or jumping, they can enjoy very exciting experiences.

Referring next to FIG. 6, an explanation on the robot utilized as an amusement park ride will be given.

As shown, a variety of amusement park instruments are installed around the robot 1. For example, there is provided an amusement park system including a robot walking road 100 along which the robot 1 walks or runs, a robot free riding section 150 in which the robot 1 dances or takes various action, a roller coaster 200 to which the robot 1 is connected and flies, a tunnel 300 for theme parks adapted to provide a variety of theme experiences to the riders, and a boarding area and an elevator 101 connected to the boarding area.

Referring to FIG. 7, an example of a boarding area prepared for the robot boarding of the pilot (or a steward) and riders is described.

The elevator 101 for the boarding area has a lower entrance door 102 and an upper entrance door 103 to permit people to reach easily the head 2 of the robot 1. After their arrival, they enter the head 2 of the robot 1 by using the boarding vehicle 20 or directly board the boarding space formed in the head 2 of the robot 1.

Referring next to FIGS. 8 and 9, a system allowing the robot 1 to walk and operate safely will be described.

As noted above, the walking technologies of the bipedal walking robot have been brilliantly developed. However, since safety should be most importantly observed in amusement parks, there is a definite need for the installation of a device for preventing safety accidents to occur. As shown in FIG. 8, the safety cable connector 6 is disposed on the back surface of the head 2 of the robot 1, to which a safety cable 502 is rigidly connected.

The safety cable 502 is connected to a safety rail moving wheel 512 by means of a safety cable rotary shaft 511 preventing the twisting of the safety cable 502. The safety rail moving wheel 512 is mounted at upper and lower rails 510A and 510B located on a safety rail part 500 and is moved naturally together with the movement of the robot 1. The safety rail part 500 is rigidly supported by means of safety rail support posts 501. The safety cable 502, which is made of a super strong material resisting the weight of the robot 1, is designed to such a length that it is possible to prevent the head 2 of the robot 1 from colliding directly against the ground. That is, even though the robot 1 loses his balance and falls down, the safety cable 502 serves to prevent the head 2 of the robot 1 from colliding directly against the ground, completely ensuring the safety of the riders.

Referring to FIGS. 10 and 11, next, a method of allowing the robot 1 coupled to a roller coaster to be moved safely will be explained.

A roller coaster 200 is safely fixed by means of roller coaster support posts 201. The roller coaster 200 has a roller coaster moving vehicle 230 provided thereon in such a manner as to be ascended and descended by the movement of roller coaster wheels 231 along roller coaster rails 233, providing various riding. The roller coaster moving vehicle 230 has connection arm connectors 234 mounted at the lower end portion thereof in such a manner as to allow head and body connection arms 210 and 220 to be located thereon, and thus, the robot 1 is connected to the head and body connection arms 210 and 220 of the roller coaster 200, as shown in FIG. 10.

The head connection arm 210 is coupled to the head connector 7 of the robot 1 by means of a head connection arm fixing protrusion 211 and a head connection arm fixing nut 212. The body connection arm 220 is coupled to the upper body connector 8 disposed on the back surface of the upper body 4 of the robot 1 by means of a body connection arm fixing protrusion 221 and a body connection arm fixing nut 222. The robot 1 is coupled to the roller coaster 200 by means of the head connection arm 210 and the body connection arm 210, and thus, as the roller coaster moving vehicle 230 is moved, the robot 1 can fly in the sky, providing exciting and safe flying to the riders.

Also, the roller coaster 200 has the safety rail part 500 mounted thereon so as to provide another safety device for preventing safety accidents to occur.

As shown in FIG. 11, the safety rail part 500 is mounted along the lower portion of the roller coaster 200 and has the safety rail moving wheel 512 mounted at the inside thereof in such a manner as to be moved along the upper and lower safety rails 510A and 510B thereof, the safety rail moving wheel 512 being connected to the robot 1 by means of the safety cable 502.

Further, the coupling process of the robot 1 to the roller coaster 200 is carried out by directly connecting the head connection arm 210 and the body connection arm 220 to the head connector 7 and the upper body connector 8 by means of the arms and hands of the robot 1 utilizing his artificial intelligence, and alternatively, the coupling process can be carried out in a manually operating manner for the safety thereof. At this time, a safety supervisor should check or approve whether the connection is safely achieved.

Referring to FIG. 12, next, an explanation on the experiences of the riders as the robot 1 is passed through the tunnel 300 for theme parks will be given.

Of course, the safety rail part 500 is installed along the tunnel 300 for theme parks so as to allow the robot 1 to walk and move safely. If a villain robot 310 that stands by or is installed in the tunnel 300 appears and takes action to threaten the robot 1, the robot 1 takes action to threat the robot 1, the robot 1 takes action to emit virtual laser to the villain robot 310 or hit him with his fist so as to drive the villain robot 310 away in accordance with control programs previously inputted. At this time, if a variety of sound effects, illumination facilities, and video play are provided in the tunnel 300, more exciting experiences can be provided to the riders.

Referring next to FIGS. 13 to 15, a method for coupling the robot 1 to a safety vehicle 30, not to the safety cable 500 will be described.

The robot 1 has a safety vehicle connector 12 disposed on the body thereof, to which a part of heavy equipment such as a fork crane is connected. Since this is well known in the art, and the detailed description is avoided.

The safety vehicle 30 is coupled to the robot 1 at the back of the robot, and even though the robot 1 loses his balance, the safety vehicle 30 serves to prevent the robot 1 from falling down. In one example, further, the installation of the safety rail part 500 is not needed, reducing the installation cost.

As shown in FIG. 16, next, the height of the robot 1 is varied in accordance with the tendency and ages of the riders boarding the robot 1.

That is, in an example of the robot being used for children, it may have a height in a range of 1.5 m to 3 m, so that they can enjoy riding without a mental burden and the riding for one child is possible.

In an example of the robot being used for family members, e.g., including children, adults and old people, it may have a height in a range of 3 m to 7 m is provided, such that the entire family may enjoy riding.

In an example of the robot being used for adults, being older than middle school students (e.g., older than 14), it may have a height in a range of 7 m to 15 m, such that they can enjoy riding with more excitement and thrill. Also, in an example of the robot being used for adults having extreme interests in robots or more experience riding such robots, it may have a height greater than 15 m, such that they can enjoy riding with extreme excitement and thrill.

As mentioned above, the degrees of thrill and excitement may be varied in accordance with the heights of the robots and boarding spaces.

Referring next to FIG. 17, a method for coupling the robot 1 to the safety vehicle located on underground rails will be described. In this method, the safety cable or the safety vehicle helping the safe bipedal walking of the robot 1 is located under the ground, and it is not exposed to the outside, enhancing the visual effects.

As shown in FIG. 18, next, the seats for riders are additionally provided into the body of the robot 1, especially, into the front portion of the chest, increasing the number of riders for the robot 1.

Next, FIG. 19 is an air view showing an example wherein the robot 1 is coupled to the safety vehicle.

While the embodiments have been described with reference to the particular illustrative embodiments, it is not to be restricted by the embodiments but only by the appended claims. It is to be appreciated that those skilled in the art can change or modify the embodiments without departing from the scope and spirit of embodiments.

According to embodiments, there is provided the large bipedal walking robot that a human can directly board and ride and that can be utilized as an amusement park ride, wherein the robot can walk, run and fly with the connection of a safety device, providing the effects of really experiencing the ride like a roller coaster and also providing entertainment effects obtained through the experience of beating villain robots.

With the development of computer graphic, especially, various robot movies appear with the real-like pictures, and the technologies of the bipedal walking robots such as humanoid robots "Asimo" and "Hubo" have been developed, so that many interests on the robots have been shown recently.

In this case, a theme park, "Robot Land" is being constructed by Incheon and Masan cities according to national promoting business in Korea. Therefore, embodiments give experiences of really seeing and directly boarding the large bipedal walking robots, providing new exciting amusement park rides to riders and improving their imagination on the robots.

Additionally, embodiments provide fun and theme different from existing amusement park instruments, having differential advantages when compared with the existing amusement park instruments and giving industrial attraction to the amusement park having the robot and ride system installed therein.

Embodiments include a large rideable bipedal walking robot that humans can directly board and ride like amusement park rides, while adopting the walking technologies of existing humanoid robots having human-like sizes, and therefore, a large heavy equipment technology, that is, an actuator using hydraulic cylinders is needed. Accordingly, embodiments can be a technology proposed for the first time in the world, which is completely different from the robot fields suggested conventionally.

Accordingly, embodiments have been made in view of the above-mentioned problems occurring in the prior art, and it is an object of embodiments to provide a large rideable bipedal walking robot that a human can directly board and ride and that can be utilized as an amusement park ride, wherein the bipedal walking robot is coupled to a ride like a roller coaster to provide a novel amusement park system, allowing riders to enjoy the riding and also allowing them to really experience the riding to satisfy their scientific imagination on the robot.

According to embodiments, there is provided the large rideable bipedal walking robot that the human can directly board and ride and that can be utilized as an amusement park ride, wherein the robot can walk, run and fly with the connection to various safety devices, providing the effects of really experiencing the ride like a roller coaster and also providing entertainment effects obtained through the experience of beating villain robots.

Also, the scientific utilization value of the bipedal walking robot defined as helper robots cleaning house and carrying coffee is extended to amusement park rides providing visual fun and experiences in theme parks or travel famous places.

Therefore, embodiments give experiences of new rides to riders and provides chances of really seeing and directly boarding the large bipedal walking robots seen just in animations or SF movies, improving imagination on the robots and growing their dream for science.

Further, users of the amusement park where the large bipedal walking robots are prepared can have more excitement and experiences through the special movements and grand sizes of the robots, which are not obtained in existing amusement park rides and roller coasters.

Additionally, embodiments provide fun and theme different from existing amusement park rides to riders, having differential advantages when compared with the existing amusement park rides and giving industrial attraction to the amusement park having the robot and ride system installed therein.

A number of examples have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A large rideable bipedal walking robot, comprising:
- an upper body in which are mounted:
  - a control unit;
  - a driving source; and
  - an energy source;
- arm links mounted on two sides of the upper body;
- leg links mounted on a lower portion of the upper body, the driving source activating the arm links and leg links; and
- a head mounted on a top portion of the upper body and comprising:
  - a boarding space portion formed within the head, above the upper body;
  - a safety cable connector mounted on the head; and
  - an entrance door formed at a back surface of the head and configured to be opened and closed, through which a boarding vehicle is configured to enter the boarding space.

2. The large rideable bipedal walking robot of claim 1, wherein the head further comprises front and back insertion grooves formed therein; and
- the boarding vehicle comprises:
  - a front insertion protrusion formed at a front surface thereof and configured to be inserted into the front insertion groove formed on the head; and
  - a back insertion groove connector mounted at a back surface thereof and configured to be fixed to the back insertion groove formed on the head.

3. The large rideable bipedal walking robot of claim 1, wherein the head comprises headlights and a speaker mounted thereon.

4. The large rideable bipedal walking robot of claim 1, wherein the robot is connected to a roller coaster moving vehicle of a roller coaster.

5. The large rideable bipedal walking robot of claim 4, wherein the head comprises a head connector; the upper body comprises an upper body connector; and the head connector and the upper body connector are configured to allow the robot to be fastened to the roller coaster.

6. The large rideable bipedal walking robot of claim 1, wherein the upper body comprises a safety vehicle connector mounted on a back surface thereof and is configured to connect the robot to a safety vehicle, the safety vehicle being configured to prevent the robot from falling down.

7. The large rideable bipedal walking robot of claim 6, wherein the safety vehicle weighs more than the robot and is configured to be connected to a back of the robot, the safety vehicle configured to:
- move according to a moving speed of the robot;
- maintain balance of the robot; and
- prevent the robot from falling down.

8. The large rideable bipedal walking robot of claim 1, wherein the upper body comprises a boarding space portion in which seats for riders are arranged.

9. The large rideable bipedal walking robot of claim 1, wherein a distance between the robot and the boarding space portion of the head thereof from the ground at the time when the robot is erected is varied within ranges set in accordance with an age and a tendency of a rider.

10. The large rideable bipedal walking robot of claim 9, wherein:

when the rider is a child, a height of the robot is in a range of 1.5 m to 3 m;

when the rider is any of a group comprising children, adults and old people, a height of the robot is in a range of 3 m to 7 m;

when the rider is an adult, a height of the robot is in a range of 7 m to 15 m; and when the rider is an adult having extreme interest in robots, a height of the robot is greater than 15 m.

11. An amusement park system using a large rideable bipedal walking robot, the amusement park system comprising:

a safety rail part mounted along a walking road of the rideable bipedal walking robot and comprising upper and lower rails formed protrudedly from the inside upper and lower sides thereof;

a safety cable adapted to connect a safety cable connector mounted on a head of the robot to the safety rail part, a boarding space portion formed within the head and above an upper body of the robot;

an entrance door formed at a back surface of the head and configured to be opened and closed, through which a boarding vehicle is configured to enter; and a moving wheel configured to be connected to the safety cable and to move along the inside upper and lower rails of the safety rail part.

12. The amusement park system using a large rideable bipedal walking robot of claim 11, wherein the safety cable is fastened to a safety cable rotary shaft adapted to be rotated around the moving wheel, preventing the safety cable from twisting.

13. The amusement park system using a large rideable bipedal walking robot of claim 11, wherein the safety rail part is installed at a predetermined height distance from the ground by safety rail support posts.

14. The amusement park system using a large rideable bipedal walking robot of claim 11, further comprising a tunnel comprising the safety rail part and a plurality of special effects devices mounted therein, the tunnel being configured to allow the rideable bipedal walking robot to pass through.

15. An amusement park system using a large rideable bipedal walking robot, the amusement park system comprising:

a roller coaster installed along a predetermined passageway, supported by support posts;

a roller coaster moving vehicle adapted to be mounted inside the roller coaster and configured to be moved along the roller coaster;

a head connection arm and an upper body connection arm adapted to connect the roller coaster moving vehicle to a head and an upper body of the robot; and the robot adapted to be suspended from the roller coaster moving vehicle and to be moved along the roller coaster in a state of being spaced apart from the ground.

16. The amusement park system using a large rideable bipedal walking robot of claim 15, further comprising:

a safety rail part mounted along the lower portion of the roller coaster;

a safety rail moving wheel mounted at the inside of the safety rail part and adapted to be moved along safety rails of the safety rail part; and a safety cable adapted to connect the robot along the safety rail moving wheel.

* * * * *